US009086222B2

(12) United States Patent
Tai et al.

(10) Patent No.: US 9,086,222 B2
(45) Date of Patent: Jul. 21, 2015

(54) VENTILATION SYSTEM WITH CONTROLLABLE AIR INPUT AND OUTPUT

(75) Inventors: Chang-Hsien Tai, Neipu Hsiang (TW); Jr-Ming Miao, Neipu Hsiang (TW); Shi-Wei Lo, Neipu Hsiang (TW); Jyh-Tong Teng, Neipu Hsiang (TW)

(73) Assignee: National Pingtung University of Science and Technology, Pingtung County (TW)

( * ) Notice: Subject to any disclaimer, the term of this patent is extended or adjusted under 35 U.S.C. 154(b) by 1006 days.

(21) Appl. No.: 13/213,167

(22) Filed: Aug. 19, 2011

(65) Prior Publication Data

US 2012/0329380 A1 Dec. 27, 2012

(30) Foreign Application Priority Data

Jun. 24, 2011 (TW) ..... 100122288 A

(51) Int. Cl.

| | |
|---|---|
| ***F24F 11/02*** | (2006.01) |
| ***F24F 7/04*** | (2006.01) |
| ***F24F 11/053*** | (2006.01) |
| *F24F 11/00* | (2006.01) |

(52) U.S. Cl.

CPC ..... *F24F 7/04* (2013.01); *F24F 11/053* (2013.01); *F24F 2011/0098* (2013.01)

(58) Field of Classification Search

CPC ..... F24F 7/04; A62C 3/002; A62C 3/14
USPC ..... 454/243, 239
See application file for complete search history.

(56) References Cited

U.S. PATENT DOCUMENTS

| | | | | | |
|---|---|---|---|---|---|
| 61,820 | A | * | 2/1867 | Estes | 454/250 |
| 93,007 | A | * | 7/1869 | Roberts | 454/265 |
| 209,506 | A | * | 10/1878 | Owens | 454/9 |
| 658,169 | A | * | 9/1900 | Avery | 454/8 |
| 679,932 | A | * | 8/1901 | Abrahamson | 454/8 |
| 1,201,172 | A | * | 10/1916 | Gray | 454/9 |
| 1,414,722 | A | * | 5/1922 | Boynton | 137/72 |
| 1,893,900 | A | * | 1/1933 | McClintock | 454/243 |
| 1,907,928 | A | * | 5/1933 | Zaloudek et al. | 454/259 |
| 1,926,295 | A | * | 9/1933 | Martin | 454/250 |
| 2,299,833 | A | * | 10/1942 | Mader | 454/344 |
| 2,358,397 | A | * | 9/1944 | Howle | 454/1 |
| 2,364,144 | A | * | 12/1944 | Hunsaker | 454/239 |
| 2,718,187 | A | * | 9/1955 | Frisby | 454/260 |
| 2,739,521 | A | * | 3/1956 | Spear | 454/349 |
| 2,755,728 | A | * | 7/1956 | Frisby | 454/275 |

(Continued)

*Primary Examiner* — Gregory Huson
*Assistant Examiner* — Martha Becton
(74) *Attorney, Agent, or Firm* — Alan D. Kamrath; Kamrath IP Lawfirm, P.A.

(57) ABSTRACT

The invention discloses a ventilation system including an inner, an outer tube and an air intake and exhaust apparatus. The inner tube has one end extending in a radial direction, wherein an air outlet and an air outlet are formed on the inner tube. An exhaust channel is formed between the inner and outer tubes, and the supporting member is disposed in the exhaust channel. The air intake and exhaust apparatus comprises an elevating member, a plurality of driving members and a cover plate. The elevating member has a connection block. The driving members are made of expandable material. The cover plate is rotatably coupled with the inner tube and has a connection portion. The connection portion abuts against the connection block when the driving members are not expanding. The connection portion of the cover plate disengages from the connection block when the driving members are expanding.

20 Claims, 5 Drawing Sheets

(56) References Cited

U.S. PATENT DOCUMENTS

| | | | | | |
|---|---|---|---|---|---|
| 2,818,060 | A | * | 12/1957 | Field | 126/307 R |
| 2,895,398 | A | * | 7/1959 | Hekelaar | 454/241 |
| 2,916,983 | A | * | 12/1959 | Kinkead | 454/8 |
| 2,966,838 | A | * | 1/1961 | Thompson et al. | 454/8 |
| 3,076,469 | A | * | 2/1963 | Averill | 137/74 |
| 3,229,610 | A | * | 1/1966 | Webster | 454/335 |
| 3,312,159 | A | * | 4/1967 | Shepherd | 454/369 |
| 3,315,586 | A | * | 4/1967 | Marrapese et al. | 454/8 |
| 3,430,549 | A | * | 3/1969 | Hershey et al. | 454/8 |
| 3,495,606 | A | * | 2/1970 | Phillips | 137/75 |
| 3,543,439 | A | * | 12/1970 | Pantland | 49/7 |
| 3,687,055 | A | * | 8/1972 | Dean et al. | 454/369 |
| 3,720,153 | A | * | 3/1973 | Jardinier et al. | 454/369 |
| 3,726,202 | A | * | 4/1973 | Ahlberg | 454/228 |
| 3,821,924 | A | * | 7/1974 | Walters | 126/299 E |
| 3,899,156 | A | * | 8/1975 | McCabe | 251/303 |
| 4,080,978 | A | * | 3/1978 | McCabe | 137/79 |
| 4,146,048 | A | * | 3/1979 | McCabe | 137/75 |
| 4,177,716 | A | * | 12/1979 | Bowe et al. | 454/50 |
| 4,184,288 | A | * | 1/1980 | Magill et al. | 49/7 |
| 4,269,166 | A | * | 5/1981 | Worley et al. | 126/285 R |
| 4,273,032 | A | * | 6/1981 | Spain | 454/9 |
| 4,295,486 | A | * | 10/1981 | McCabe | 137/80 |
| 4,366,830 | A | * | 1/1983 | Becelaere | 137/75 |
| 4,372,485 | A | * | 2/1983 | McCabe | 236/1 G |
| 4,467,824 | A | * | 8/1984 | Strulik et al. | 137/74 |
| 4,562,853 | A | * | 1/1986 | Tschirky et al. | 137/75 |
| 4,605,162 | A | * | 8/1986 | Crider | 236/49.5 |
| 4,817,912 | A | * | 4/1989 | McCabe | 251/11 |
| 4,848,653 | A | * | 7/1989 | Van Becelaere | 236/49.3 |
| 4,919,329 | A | * | 4/1990 | McCabe | 236/93 R |
| 4,936,287 | A | * | 6/1990 | Hart et al. | 126/287.5 |
| 5,217,407 | A | * | 6/1993 | Bailey | 454/257 |
| 5,245,879 | A | * | 9/1993 | McKeon | 74/2 |
| 5,565,274 | A | * | 10/1996 | Perrone et al. | 428/457 |
| 5,584,312 | A | * | 12/1996 | Van Becelaere | 137/78.5 |
| 5,595,026 | A | * | 1/1997 | Licking et al. | 49/360 |
| 5,695,116 | A | * | 12/1997 | Karabin | 236/1 G |
| 5,839,230 | A | * | 11/1998 | Licking et al. | 49/360 |
| 6,022,271 | A | * | 2/2000 | Biondo | 454/369 |
| 6,301,108 | B1 | * | 10/2001 | Stockbridge | 361/688 |
| 6,425,211 | B1 | * | 7/2002 | Wise et al. | 52/1 |
| 6,722,972 | B1 | * | 4/2004 | Holtkamp | 454/256 |
| 7,798,684 | B2 | | 9/2010 | Boissevain | |
| 7,821,151 | B2 | | 10/2010 | Le et al. | |
| 2008/0207109 | A1 | * | 8/2008 | Bagwell et al. | 454/237 |
| 2010/0178862 | A1 | * | 7/2010 | Sahm et al. | 454/254 |
| 2010/0279597 | A1 | * | 11/2010 | Cho et al. | 454/341 |

* cited by examiner

VENTILATION SYSTEM WITH CONTROLLABLE AIR INPUT AND OUTPUT

BACKGROUND OF THE INVENTION

1. Field of the Invention

The present invention generally relates to a ventilation system with controllable air input and output and, more particularly, to a ventilation system with controllable air input and output that is installed in a building to control ventilation of the building.

2. Description of the Related Art

Referring to FIG. 1, a conventional tube-type air intake and exhaust structure is shown. The air intake and exhaust structure comprises a ventilation system 9 having an inner tube 91 and an outer tube 92 coaxial with the inner tube 91. The inner tube 91 has an intake air channel 911, and an exhaust channel 921 is formed between the inner tube 91 and the outer tube 92. The inner tube 91 has an air-guiding cover 93 at one end thereof for collecting airflows.

The ventilation system 9 further comprises an extra outer tube 94 on a top of the outer tube 92. The outer tube 94 has a windward opening 941 and an air-guiding opening 942 lower than the windward opening 941. Based on the height difference between the windward opening 941 and the air-guiding opening 942, when the wind brings the air of the windward opening 941 to the air-guiding opening 942, the air from the windward opening 941 will cause the air of the air-guiding opening 942 to whirl. This will enhance an air-pulling effect at the air-guiding opening 942. The air-pulling effect will speed up the air circulation of the ventilation system 9, thereby providing better ventilation.

However, the ventilation system 9 is not equipped with any device that can stop its air circulation when it is desired. For example, when the ventilation system 9 is connected to architecture such as a factory or a tunnel where a fire accident takes place, the ventilation system 9 may instead cause the fire to spread quickly due to good air circulation provided thereby. In light of this problem, it is desired to improve the ventilation system 9.

SUMMARY OF THE INVENTION

It is therefore the primary objective of this invention to provide a ventilation system with controllable air input and output which can stop external air from entering the ventilation system. Thus, fire can be prevented from spreading.

It is another objective of this invention to provide a ventilation system with controllable air input and output which can allow more heat to be expelled when a fire accident takes place, thereby speeding up the heat expelled.

The invention discloses a ventilation system with controllable air input and output, which comprises an inner, an outer tube and an air intake and exhaust apparatus. The inner tube has one end extending in a radial direction of the ventilation system, wherein an air outlet is formed on a top face of the inner tube, and an air inlet is formed at the end of the inner tube extending in the radial direction. The outer tube is disposed around and coaxial with the inner tube, wherein an exhaust channel is formed between the inner tube and the outer tube, and at least one supporting member is disposed in the exhaust channel. The air intake and exhaust apparatus comprises an elevating member, a plurality of driving members and a cover plate. The elevating member has a connection block. The driving members are disposed on the at least one supporting member under the elevating member, wherein the driving members are made of expandable material such that the driving members are capable of lifting up the elevating member after being heated. The cover plate is rotatably coupled with the inner tube and has a connection portion. The connection portion of the cover plate abuts against the connection block and the air outlet of the inner tube is closed by the cover plate when the driving members are not expanding, and the connection portion of the cover plate disengages from the connection block and the cover plate starts to pivot when the driving members are expanding, so that the air inlet other than the air outlet of the inner tube is closed by the cover plate.

Furthermore, the invention discloses an air intake and exhaust apparatus of a ventilation system with controllable air input and output, which comprises an elevating member, a plurality of driving members and a cover plate. The elevating member has a connection block. The driving members are disposed under the elevating member, wherein the driving members are made of expandable material such that the driving members are capable of lifting up the elevating member after being heated. The cover plate has a pivot portion and a connection portion. The connection portion of the cover plate abuts against the connection block when the driving members are not expanding, and the connection portion of the cover plate disengages from the connection block and pivots on the pivot portion when the driving members are expanding.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
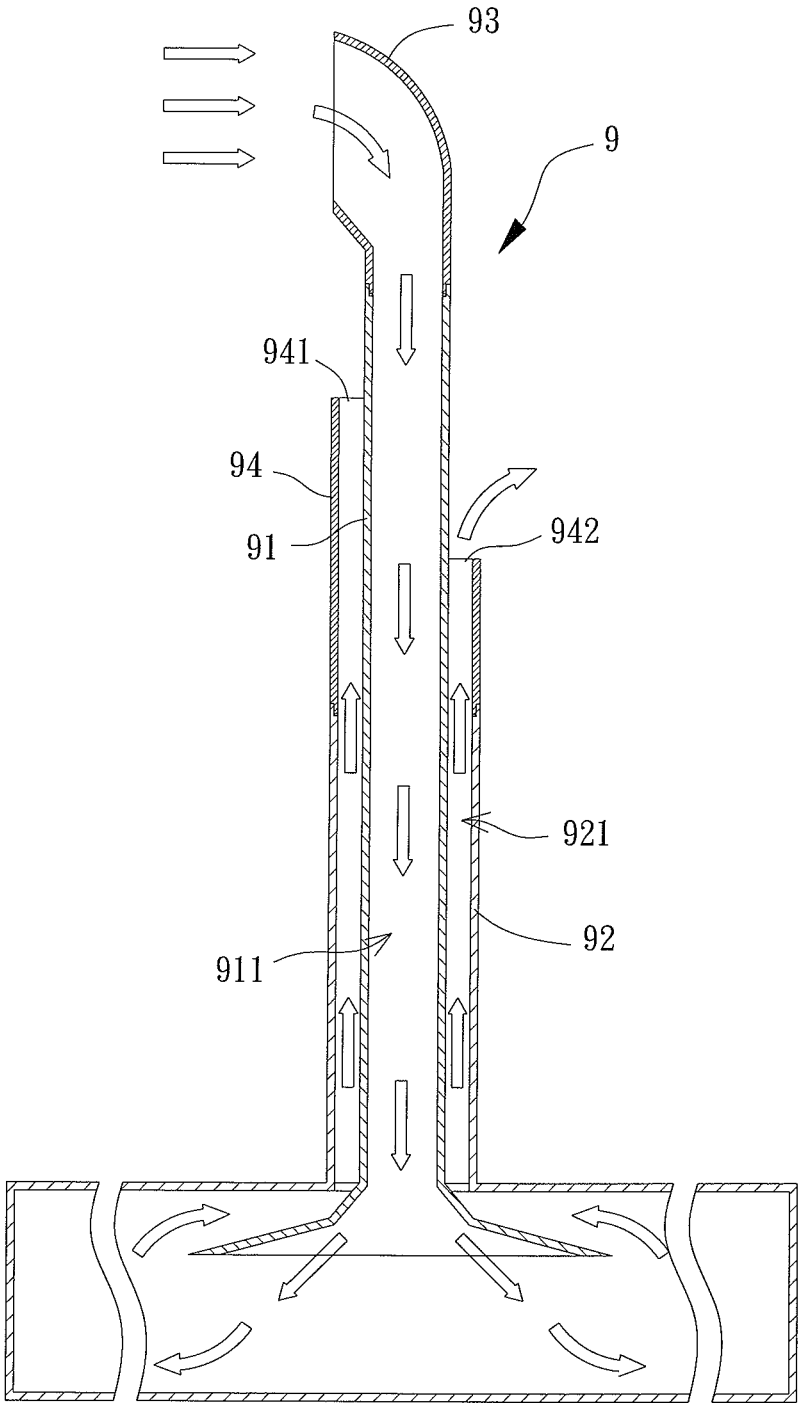
FIG. 1 PRIOR ART
FIG. 1 is a cross-sectional view of a ventilation system.

In the various figures of the drawings, the same numerals designate the same or similar parts. Furthermore, when the term "first", "second", "third", "fourth", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
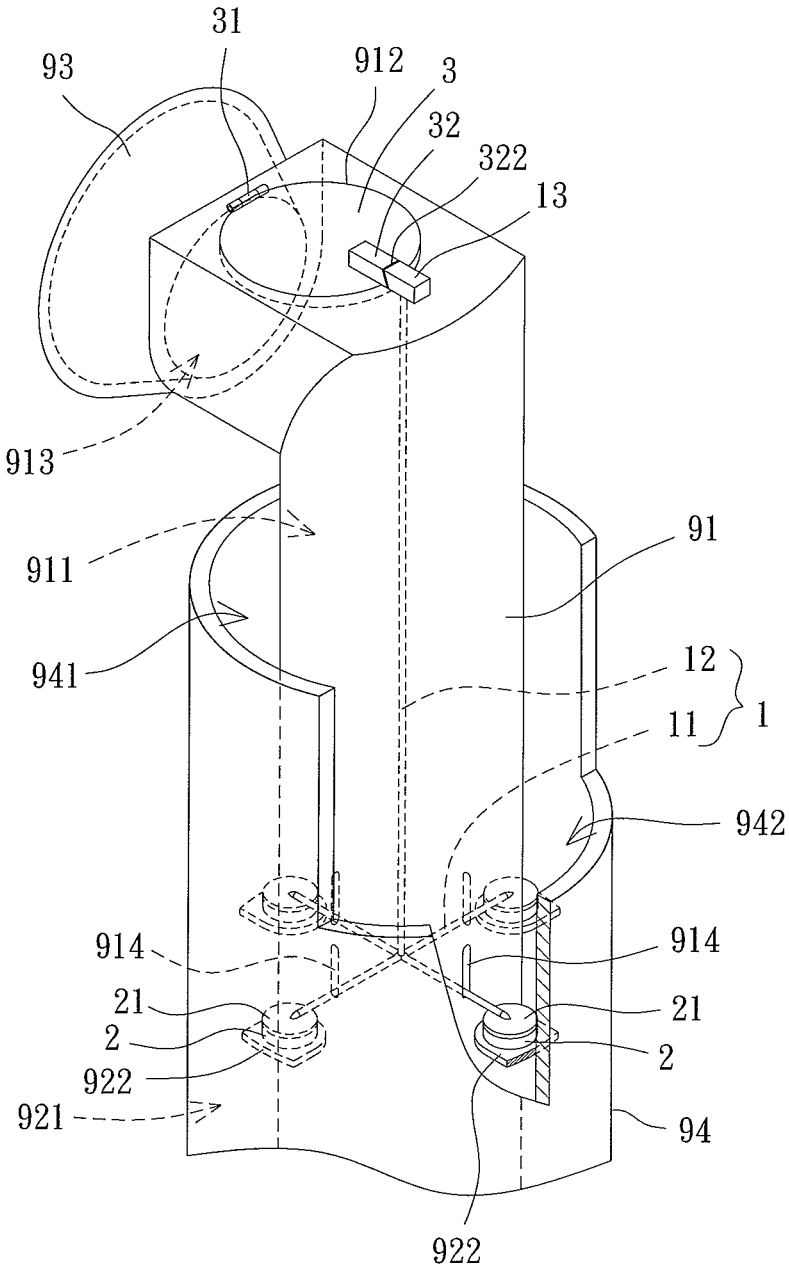
FIG. 2 is a cross-sectional view of the ventilation system equipped with an air intake and exhaust apparatus according to a preferred embodiment of the invention.

Referring to FIG. 2, the ventilation system 9 equipped with an air intake and exhaust apparatus for regulating ventilation of the ventilation system 9 is shown according to a preferred embodiment of the invention. The air intake and exhaust apparatus comprises an elevating member 1, a plurality of driving members 2 and a cover plate 3. The air intake and exhaust apparatus is installed in the ventilation system 9.

Figure 4:
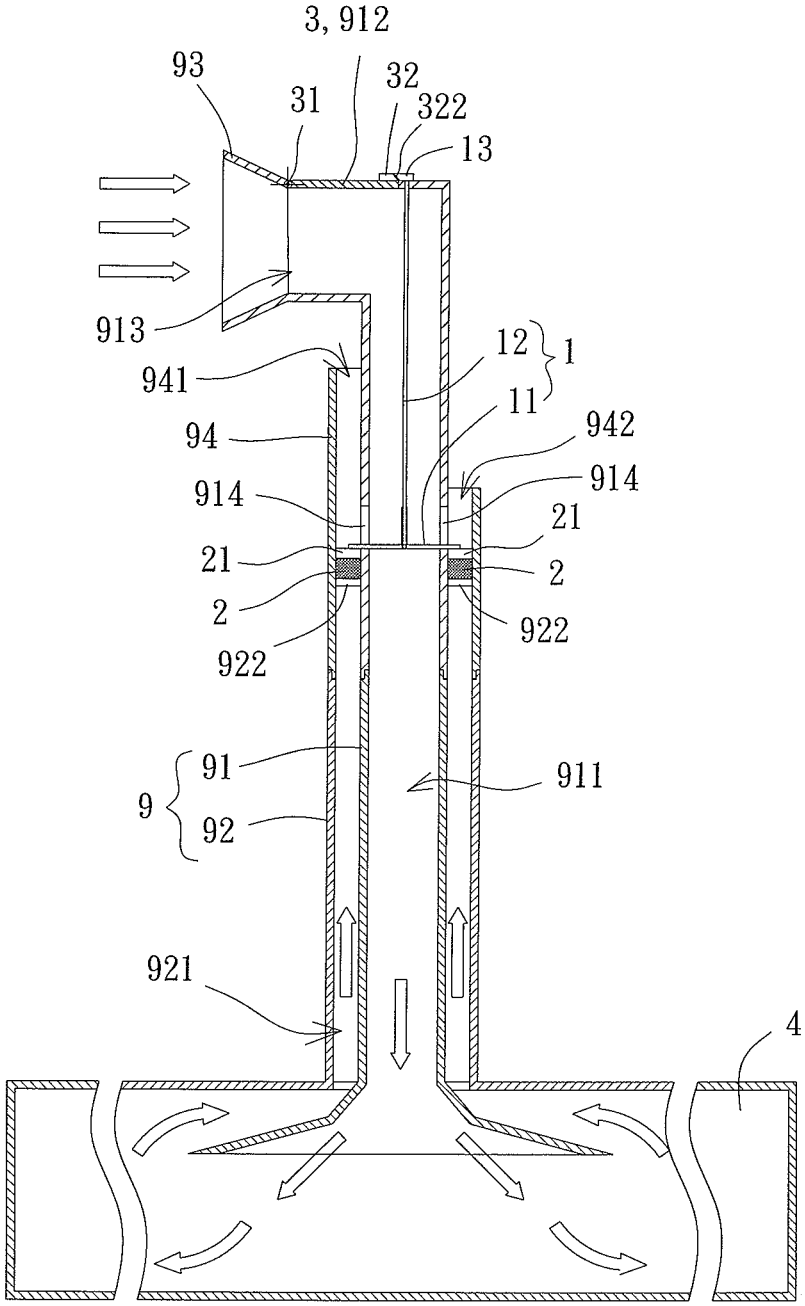
FIG. 4 is a cross-sectional view of the ventilation system in which external air is shown to enter the ventilation system.

The ventilation system 9 comprises an inner tube 91 and an outer tube 92 coaxial with the inner tube 91, as shown in FIG. 4. The inner tube 91 has an intake air channel 911, and an exhaust channel 921 is formed between the inner tube 91 and the outer tube 92. The inner tube 91 has one end extending in a radial direction. The inner tube 91 further comprises an air outlet 912 on a top face thereof, as well as an air inlet 913 at the end of the inner tube 91 extending in the radial direction. Note both the air outlet 912 and the air inlet 913 are formed on the same end of the inner tube 91. The driving members 2 are arranged under the elevating member 1. The cover plate 3 is connected to a top end of the elevating member 1 for closing the air outlet 912. The driving members 2 may lift the elevating member 1 up when being heated. When the elevating member 1 is lifted, the cover plate 3 will disengage from the elevating member 1 to close the air inlet 913, thereby stopping external air from entering the inner tube 91 via the air inlet 913. A washer may be disposed on a periphery of the air inlet 913 to relieve the impact of the cover plate 3 hitting the air inlet 913, and to seal the air inlet 913 when the air inlet 913 is closed by the cover plate 3.

In the embodiment, the inner tube 91 may further comprise an air-guiding cover 93 at the air inlet 913 to facilitate receiving the airflows. The air-guiding cover 93 is preferably in a horn-like shape with increasingly-expanded diameter for better air-receiving capability. The air inlet 913 has substantially the same shape and size as the air outlet 912, so that the cover plate 3 can close the air inlet 913 and the air outlet 912 in turn to control the ventilation of the ventilation system 9. The outer tube 92 further comprises an additional outer tube 94 on the outer tube 92. In such an arrangement, the outer tube 92 may form a windward opening 941 and an air-guiding opening 942 on a top thereof, wherein the air-guiding opening 942 is lower than the windward opening 941.

Referring to FIG. 2, the elevating member 1 may comprise at least one driven rod 11 and a connection rod 12. In the embodiment, the elevating member 1 comprises a plurality of driven rods 11 intersecting each other at a middle point thereof, wherein the driven rods 11 are arranged in a manner that any two adjacent driven rods 11 have the same included angle as another adjacent two driven rods 11. The intersected driven rods 11 can help stabilize the elevating member 1 as the elevating member 1 lifts or lowers. The connection rod 12 is disposed in the inner tube 91 and has one end connected to the intersection of the driven rods 11. The connection rod 12 also has other end extending through the top face of the inner tube 91. A connection block 13 is disposed at a top end of the connection rod 12.

Figure 3:
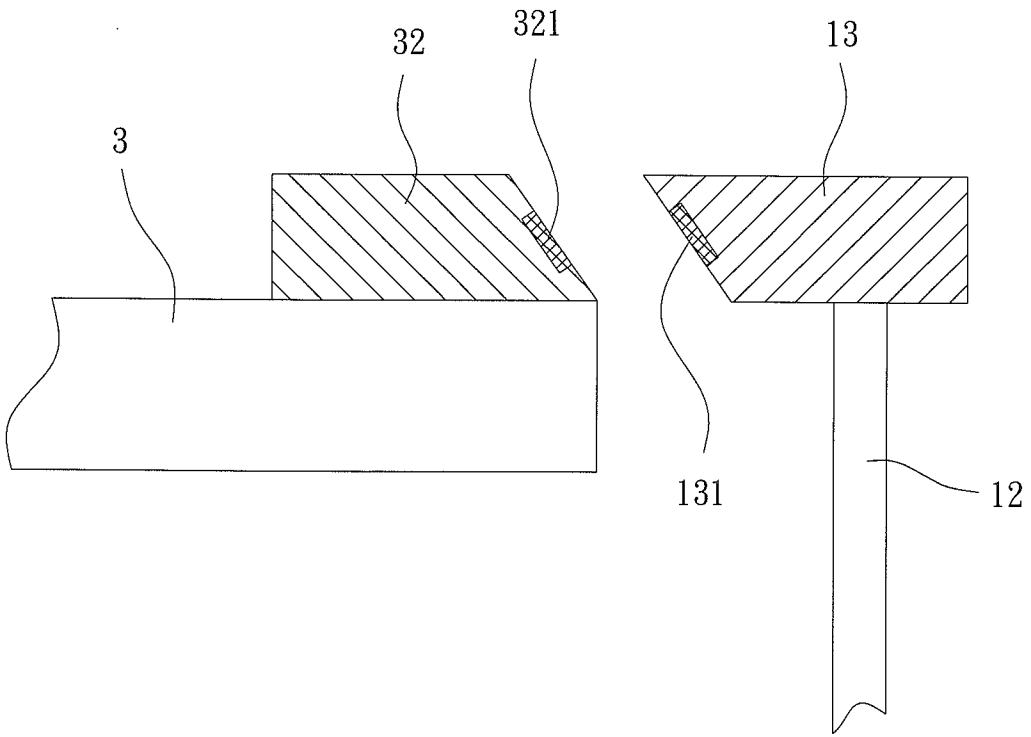
FIG. 3 shows first and second coupling members of a connection portion and a connection block.

Referring to FIGS. 2 and 3, the driving members 2 can drive the elevating member 1 to lift or lower. Preferably, two driving members 2 can be disposed under two ends of each driven rod 11. In this embodiment, the driving members 2 are made of expandable material so that the driving members 2 can have a significant expansion in an axial direction when being heated. As such, the axial expansion of the expanding driving members 2 will lift up the elevating member 1. In addition, each driving member 2 may have an assembling member 21 on a top thereof for positioning an end of the driven rod 11.

In this embodiment, the ventilation system 9 may further comprise at least one supporting member 922 located adjacent to a top end of the exhaust channel 921 for supporting the driving members 2. The at least one supporting member 922 may be a single circular grille or a plurality of plates coupled with an inner circumferential wall of the outer tube 92 (shown in FIG. 2). The inner tube 91 has a plurality of openings 914 radially arranged. The openings 914 may be in a long narrow shape, but is not limited thereto. The quantity of the openings 914 corresponds to that of the driving members 2. Thus, each driven rod 11 can have two ends extending into the exhaust channel 921 through two opposing openings 914 of the inner tube 91, so as to couple with two driving members 2.

Referring to FIG. 2, the cover plate 3 has a pivot portion 31 and a connection portion 32. The cover plate 3 has a size slightly smaller than the air inlet 913 of the inner tube 91. The pivot portion 31 of the cover plate 3 is preferably disposed on a periphery of the air inlet 913 so that the cover plate 3 can pivot on the pivot portion 31. Arrangement of the pivot portion 31 allows the cover plate 3 to optionally close up the air outlet 912 or the air inlet 913. When the cover plate 3 closes the air outlet 912, the connection portion 32 of the cover plate 3 can abut against the connection block 13 of the elevating member 1.

The connection portion 32 may have an inclined face abutting against an inclined face of the connection block 13. Alternatively, referring to FIG. 3, the connection portion 32 may have a first coupling member 321, and the connection block 13 may have a second coupling member 131. The first and second coupling members 321 and 131 may be coupled together to combine the connection portion 32 with the connection block 13. In another implementation, the connection portion 32 and the connection block 13 may be two magnetic components with different magnetic poles. Alternatively, one of the connection portion 32 and the connection block 13 may be a magnetic component while the other one is a magnetically-attractive component that can be magnetically attracted to the magnetic component. In this embodiment, the connection block 13 is implemented as a magnetic component, and a magnetically-attractive component 322 such as iron can be arranged on the face of the connection portion 32 that abuts against the connection block 13. Thus, the connection portion 32 and the connection block 13 may be magnetically coupled together. In another application, the face of the connection portion 32 abutting against the connection block 13 may be a protrusion, and the face of the connection block 13 abutting against the connection portion 32 may be a groove, or vice versa. The protrusion and groove can be coupled together by way of fastening to couple the connection portion 32 with the connection block 13. However, the coupling mechanism between the connection portion 32 and the connection block 13 is not limited to the protrusion and groove.

Referring to FIG. 4, bottom ends of the inner tube 91 and the outer tube 92 are connected to an interior space 4 of an architecture such as a factory, a tunnel or the like. This allows the intake air channel 911 and the exhaust channel 921 to communicate with the interior space 4. In a normal situation, the driving members 2 are not expanding such that the driven rods 11 of the elevating member 1 are at a lower position of the openings 914. At this point, the cover plate 3 will couple with the connection block 13 via the connection portion 32, allowing the cover plate 3 to close the air outlet 912 of the inner tube 91. In such a case, external oxygen-rich air with lower temperature can enter the interior space 4 via the air inlet 913 of the inner tube 91 and the intake air channel 911. Then, heat in the interior space 4 can be expelled via the exhaust channel 921. In this way, the heat in the interior space 4 can be circulated. In the above structure, based on the height difference between the windward opening 941 and the air-guiding opening 942, the heat expelled from the windward opening 941 will interact with the air of the air-guiding opening 942 when the wind brings the heat to the air-guiding opening 942. Therefore, the air-pulling effect at the air-guiding opening 942 can be enhanced, thereby achieving improved air circulation of the ventilation system 9.

Figure 5:
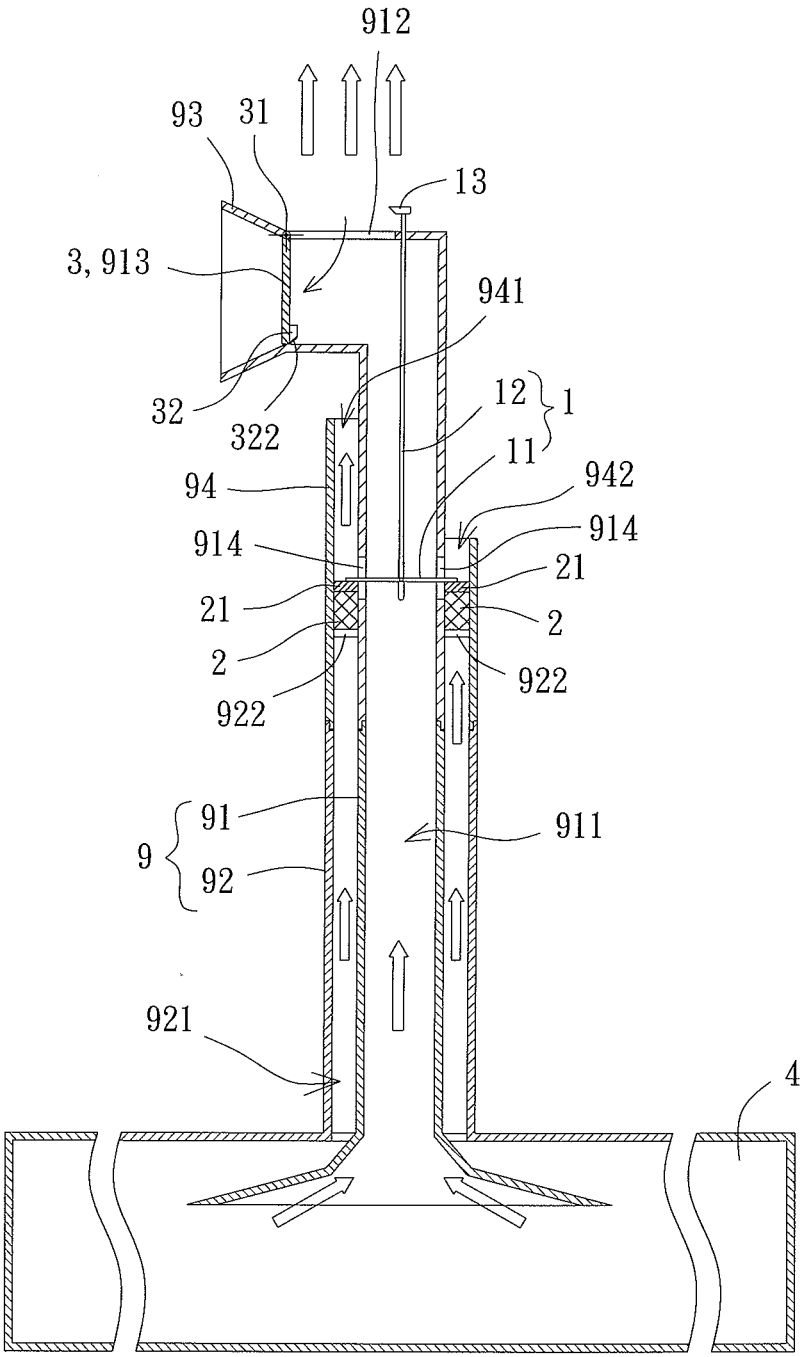
FIG. 5 is a cross-sectional view of the ventilation system in which external air is stopped from entering the ventilation system.

Referring to FIG. 5, when a massive amount of heat accumulates in the interior space 4 (such as in a case of fire accident), the driving members 2 will start to expand so that the assembling member 21 will be driven upwards. Thus, the driven rods 11 of the elevating member 1 will be moved from lower to higher position of the openings 914. At this point, the connection rod 12 will touch and push the connection block 13 upwards, casing the connection block 13 to disengage from the connection portion 32. As a result, the cover plate 3 will lose contact with the connection block 13 and starts to fall. As the cover plate 3 starts falling, the cover plate 3 will pivot on the pivot portion 31 and finally close up the air inlet 913 of the inner tube 91. Therefore, the cover plate 3 will stop external air from entering the interior space 4 and no more oxygen can be provided to the interior space 4, thereby stopping the fire from spreading. In this situation, the intake air channel 911 will become an exhaust channel for expelling the heat of the interior space 4, and the heat of the interior space 4 will be expelled via the air outlet 912 of the inner tube 91. This can keep the temperature of the interior space 4 from rising significantly while lowering the carbon dioxide density of the interior space 4.

After the fire is put out, the driving members 2 will shrink as the temperature lowers. Then, the cover plate 3 can be turned to the air outlet 912 so that the connection portion 32 of the cover plate 3 will re-abut against the connection block 13 of the elevating member 1. Thus, the air outlet 912 of the inner tube 91 will be closed again. At this time, external air will enter the inner tube 91 via the air inlet 913 to re-activate air circulation of the interior space 4.

In conclusion, the ventilation system 9 of the invention can drive the air intake and exhaust apparatus to control ventilation of the ventilation system 9 based on material expansion and shrinkage, thereby maintaining high air exchange rate of the ventilation system 9. Also, the air intake and exhaust apparatus can stop air from entering the ventilation system 9 when a fire accident occurs. Thus, safety use is achieved.

When a fire accident occurs, the ventilation system 9 of the invention can allow more heat to be expelled from the ventilation system 9, thereby speeding up the heat expelled. This can stop the temperature of the interior space 4 from increasing significantly in a short time while lowering the carbon dioxide density of the interior space 4.

Note that the air-guiding cover 93 and the outer tube 94 are merely provided to facilitate air circulation of the ventilation system 9. The air intake and exhaust apparatus can still operate without arrangement of the air-guiding cover 93 and the outer tube 94.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A ventilation system with controllable air input and output, comprising:

an inner tube having one end extending in a radial direction of the ventilation system, wherein an air outlet is formed on a top face of the inner tube, and an air inlet is formed at the end of the inner tube extending in the radial direction;

an outer tube disposed around and coaxial with the inner tube, wherein an exhaust channel is formed between the inner tube and the outer tube, and at least one supporting member is disposed in the exhaust channel; and an air intake and exhaust apparatus, comprises:

an elevating member having a connection block;

a plurality of driving members disposed on the at least one supporting member under the elevating member, wherein the driving members are made of expandable material such that the driving members are capable of lifting up the elevating member after being heated; and a cover plate rotatably coupled with the inner tube and having a connection portion;

wherein the connection portion of the cover plate abuts against the connection block and the air outlet of the inner tube is closed by the cover plate when the driving members are not expanding, and the connection portion of the cover plate disengages from the connection block and the cover plate starts to pivot when the driving members are expanding, so that the air inlet other than the air outlet of the inner tube is closed by the cover plate.

2. The ventilation system with controllable air input and output as claimed in claim 1, wherein the elevating member further comprises at least one driven rod and a connection rod, the inner tube has a plurality of openings radially arranged, the quantity of the openings is the same as that of the driving members, the at least one driven rod is horizontally disposed in the openings, and each of the at least one driven rod has two ends extending into the exhaust channel to couple with two of the driving members.

3. The ventilation system with controllable air input and output as claimed in claim 2, wherein the connection rod is disposed in the inner tube, the connection rod has one end connected to the at least one driven rod, as well as other end extending through the top face of the inner tube, and the connection block is at a top end of the connection rod.

4. The ventilation system with controllable air input and output as claimed in claim 2, wherein each of the driving members has an assembling member on a top thereof for positioning an end of each of the at least one driven rod.

5. The ventilation system with controllable air input and output as claimed in claim 2, wherein the cover plate has a size slightly smaller than the air inlet of the inner tube.

6. The ventilation system with controllable air input and output as claimed in claim 2, wherein the connection portion has an inclined face abutting against an inclined face of the connection block.

7. The ventilation system with controllable air input and output as claimed in claim 6, wherein the connection portion has a first coupling member, the connection block has a second coupling member capable of being coupled with the first coupling member of the connection portion.

8. The ventilation system with controllable air input and output as claimed in claim 2, wherein the at least one supporting member is a single circular grille or a plurality of plates coupled with an inner circumferential wall of the outer tube.

9. The ventilation system with controllable air input and output as claimed in claim 2, wherein the at least one driven rod comprises a plurality of driven rods intersecting each other at a middle point thereof, and the driven rods are arranged in a manner that any adjacent two of the driven rods have the same included angle as another adjacent two of the driven rods.

10. An air intake and exhaust apparatus of a ventilation system with controllable air input and output, comprising:

an elevating member having a connection block;

a plurality of driving members disposed under the elevating member, wherein the driving members are made of expandable material such that the driving members are capable of lifting up the elevating member after being heated; and a cover plate having a pivot portion and a connection portion;

wherein the connection portion of the cover plate abuts against the connection block when the driving members are not expanding, and the connection portion of the cover plate disengages from the connection block and pivots on the pivot portion when the driving members are expanding.

11. The air intake and exhaust apparatus of a ventilation system with controllable air input and output as claimed in claim 10, wherein the air intake and exhaust apparatus is installed in the ventilation system, the ventilation system has an inner tube and an outer tube coaxial with the inner tube, the inner tube has one end extending in a radial direction of the ventilation system, an air outlet is formed on a top face of the inner tube, and an air inlet is formed at the end of the inner tube extending in the radial direction, an exhaust channel is formed between the inner tube and the outer tube, and at least one supporting member is disposed in the exhaust channel for positioning the driving members.

12. The air intake and exhaust apparatus of a ventilation system with controllable air input and output as claimed in claim 11, wherein the elevating member further comprises at least one driven rod and a connection rod, the inner tube has a plurality of openings radially arranged, the quantity of the openings is the same as that of the driving members, the at least one driven rod is horizontally disposed in the openings, and each of the at least one driven rod has two ends extending into the exhaust channel to couple with two of the driving members.

13. The air intake and exhaust apparatus of a ventilation system with controllable air input and output as claimed in claim 12, wherein the connection rod is disposed in the inner tube, the connection rod has one end connected to the at least one driven rod, as well as other end extending through the top face of the inner tube, and the connection block is at a top end of the connection rod.

14. The air intake and exhaust apparatus of a ventilation system with controllable air input and output as claimed in claim 12, wherein each of the driving members has an assembling member on a top thereof for positioning an end of each of the at least one driven rod.

15. The air intake and exhaust apparatus of a ventilation system with controllable air input and output as claimed in claim 11, wherein the cover plate has a size slightly smaller than the air inlet of the inner tube.

16. The air intake and exhaust apparatus of a ventilation system with controllable air input and output as claimed in claim 11, wherein the pivot portion of the cover plate is adjacent to the air inlet of the inner tube so that the cover plate is allowed to pivot on the pivot portion to optionally close the air inlet or the air outlet of the inner tube.

17. The air intake and exhaust apparatus of a ventilation system with controllable air input and output as claimed in claim 10, wherein the connection portion has an inclined face abutting against an inclined face of the connection block.

18. The air intake and exhaust apparatus of a ventilation system with controllable air input and output as claimed in claim 17, wherein the connection portion has a first coupling member, the connection block has a second coupling member capable of being coupled with the first coupling member of the connection portion.

19. The air intake and exhaust apparatus of a ventilation system with controllable air input and output as claimed in claim 11, wherein the at least one supporting member is a single circular grille or a plurality of plates coupled with an inner circumferential wall of the outer tube.

20. The air intake and exhaust apparatus of a ventilation system with controllable air input and output as claimed in claim 12, wherein the at least one driven rod comprises a plurality of driven rods intersecting each other at a middle point thereof, and the driven rods are arranged in a manner that any adjacent two of the driven rods have the same included angle as another adjacent two of the driven rods.

* * * * *